US007135647B2

(12) United States Patent
Takahashi

(10) Patent No.: US 7,135,647 B2
(45) Date of Patent: Nov. 14, 2006

(54) KEYBOARD

(75) Inventor: Koki Takahashi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 11/226,239

(22) Filed: Sep. 15, 2005

(65) Prior Publication Data

US 2006/0006052 A1 Jan. 12, 2006

Related U.S. Application Data

(63) Continuation of application No. PCT/JP03/07922, filed on Jun. 23, 2003.

(51) Int. Cl.
*H01H 9/26* (2006.01)
*H01H 13/72* (2006.01)
*H01H 13/76* (2006.01)

(52) U.S. Cl. ..... 200/5 A; 200/520; 200/341; 200/329

(58) Field of Classification Search ..... 200/5 A, 200/517, 344, 345; 400/490, 491, 491.2, 400/495, 495.1, 496
See application file for complete search history.

(56) References Cited

U.S. PATENT DOCUMENTS 4,503,294 A * 3/1985 Matsumaru ..... 200/5 A
5,463,195 A 10/1995 Watanabe et al.
5,510,784 A * 4/1996 Polaert et al. ..... 341/34
6,118,092 A * 9/2000 Hayashi ..... 200/344
6,541,724 B1 * 4/2003 Nozawa et al. ..... 200/517
6,706,985 B1 * 3/2004 Chun ..... 200/344
6,797,906 B1 * 9/2004 Ohashi ..... 200/517

FOREIGN PATENT DOCUMENTS

| | | |
|---|---|---|
| JP | 2800617 | 7/1998 |
| JP | 11-213806 | 8/1999 |
| JP | 2000-123680 | 4/2000 |
| JP | 2000-123681 | 4/2000 |
| JP | 3063410 | 5/2000 |
| JP | 2001-184979 | 7/2001 |
| JP | 2001-229764 | 8/2001 |

* cited by examiner

*Primary Examiner*—Elvin Enad
*Assistant Examiner*—Lheiren Mae A. Anglo
(74) *Attorney, Agent, or Firm*—Staas & Halsey LLP

(57) ABSTRACT

A keyboard has a base plate, a membrane sheet, a housing, a key-top, a link mechanism disposed between the housing and the key-top, and a switch operating member disposed under the key-top and operated by the key-top. The housing, the membrane sheet and the base plate have slits at a position corresponding to a surrounding portion of the key-top. Consequently, the distance between the key-top and the housing can be decreased even if the skirt part of the key-top is long. Furthermore, the slit of the housing is formed as a discontinuous annular shape to surround the link mechanism, and the surrounding portion of the key-top has a slit corresponding to the bridge shaped portion of the housing.

9 Claims, 3 Drawing Sheets

KEYBOARD

CROSS-REFERENCE TO RELATED APPLICATION

This application is a continuation application and is based upon PCT/JP03/07922, filed on Jun. 23, 2003.

BACKGROUND OF THE INVENTION

1. Field of the Invention

The present invention relates to a keyboard.

2. Description of the Related Art

There is well-known a keyboard comprising a base plate, a membrane sheet disposed on the base plate, a housing disposed on the membrane sheet, a key-top, a link mechanism disposed between the housing and the key-top, and a switching operation unit (refer to, for example, Japanese Unexamined Patent Publication (Kokai) No. 11-213806 and No. 2001-229764).

The key-top has a horizontal top portion, and a skirt portion obliquely hanging down from the horizontal top portion. A pivotal support portion of the link mechanism is disposed on an internal surface of the top portion of the key-top and an upper surface of the housing, and the link mechanism guides the key-top to drop down, keeping the horizontal state thereof, when the key-top is pushed. In the case of pushing the key-top, the key-top pushes down the switching operation unit made of a rubber and, thereby, the switching operation unit makes contact a pair of opposite connecting pieces of the membrane sheet.

In accordance with the recent requirements, a distance between the key-top and the housing is required to be short so as to realize a thin keyboard. However, when the key-top is pushed and the skirt portion of the key-top is long, a lower end of the skirt portion of the key-top (surrounding portion of the key-top) interferes with the housing. Therefore, the distance between the key-top and the housing cannot be short.

SUMMARY OF THE INVENTION

An object of the present invention is to provide a keyboard which can be made thin.

A keyboard in accordance with the present invention comprises a base plate; a membrane sheet disposed on the base plate; a housing disposed on the membrane sheet; a key-top; a link mechanism disposed between the housing and the key-top; and a switching operation unit disposed under the key-top and moved by the key-top, wherein the housing has a slit placed at a surrounding portion of the key-top.

In this configuration, the surrounding portion of the key-top (lower end portion of skirt portion of the key-top) can be inserted into the slit of the housing. Therefore, the distance between the key-top and the housing can be short, and a thin keyboard can be realized, when the skirt portion of the key-top is long.

Preferably, the slit of the housing may be formed as a discontinuous annular shape and has first and second ends, a bridge shaped portion of the housing placed between the first end and the second end may make contact with a part of the housing placed inside of the slit to a part of the housing placed outside of the slit, and the surrounding portion of the key-top may have a slit at a position corresponding to the portion of the housing placed between the first end and the second end.

Preferably, the membrane sheet may have a slit corresponding to the slit of the housing. Further, the base plate may have a slit corresponding to the slit of the housing and the slit of the membrane sheet. In addition, when the key-top is pushed, a bottom surface of the surrounding portion of the key-top may become approximately the same as a bottom surface of the base plate.

DESCRIPTION OF THE PREFERRED EMBODIMENTS

Figure 1:
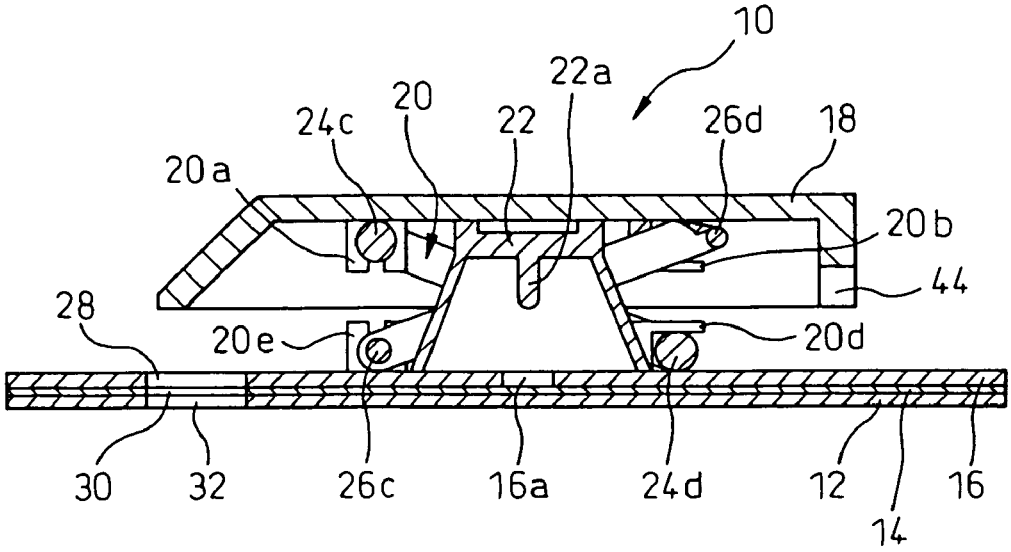
FIG. 1 is a sectional view showing an embodiment of a keyboard according to the present invention.

Below, an embodiment of a keyboard according to the present invention will be described with reference to the accompanying drawings.

A keyboard 10 comprises a base plate 12, a membrane sheet 14 disposed on the base plate 12, a housing 16 disposed on the membrane sheet 14, a key-top 18, a link mechanism 20 disposed between the housing 16 and the key-top 18 and a switching operation unit 22 disposed between the key-top 18 and the membrane sheet 14.

Figure 7:
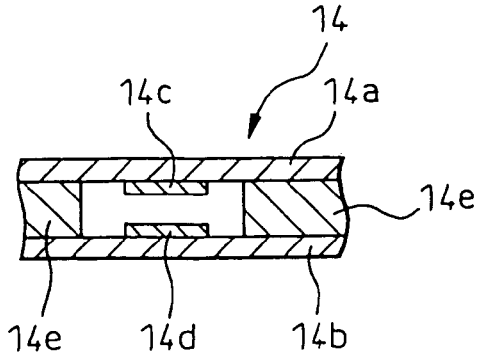
FIG. 7 is a partial sectional view showing a membrane sheet.

The base plate 12 is made of metal, and is disposed on a housing of an electronic device such as a computer (not shown). As shown in FIG. 7, the membrane sheet 14 comprises a pair of insulation sheets 14*a* and 14*b*, a pair of connecting pieces 14*c* and 14*d* disposed on an inner surface of the insulation sheets 14*a* and 14*b*. The connecting pieces 14*c* and 14*d* are normally held at a specific distance by a spacer 14*e*, and when the switching operation unit 22 drops down, the connecting pieces 14*c* and 14*d* are contacted each other by pushing. Further, the membrane sheet 14 has wiring patterns connected to the connecting pieces 14*c* and 14*d*.

The switching operation unit 22 is a rubber dome made of an elastic material, e.g., a rubber, and has a downward pushing portion 22*a* disposed at the center of the switching operation unit.

The housing 16 is a metal or resin plate, and supports a pivotal support portion of a link mechanism 20, which will be explained later. The housing 16 has an opening portion 16*a* to expose portions of the connecting pieces 14*c* and 14*d* of the membrane sheet 14, and the pushing portion 22*a* of the switching operation unit 22 is disposed over the opening portion 16*a* of the housing 16 and the connecting pieces 14*c* and 14*d* of the membrane sheet 14.

Figure 3:
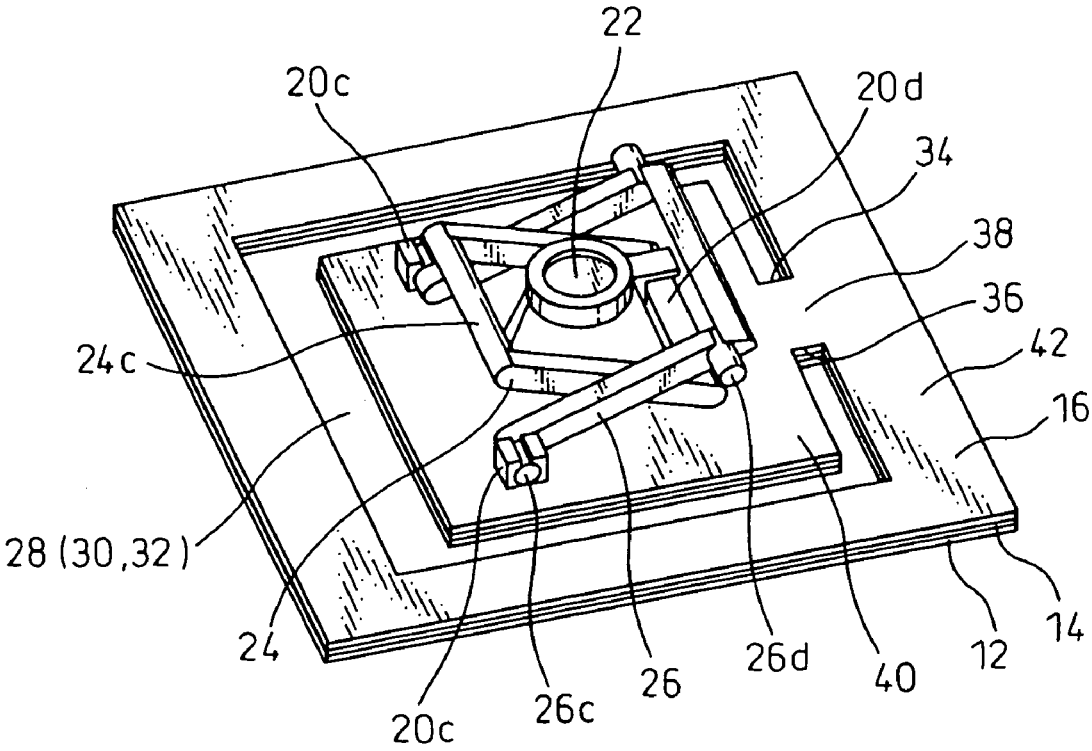
FIG. 3 is a perspective view showing the keyboard of FIG. 1 where the key-top is removed.
Figure 5:
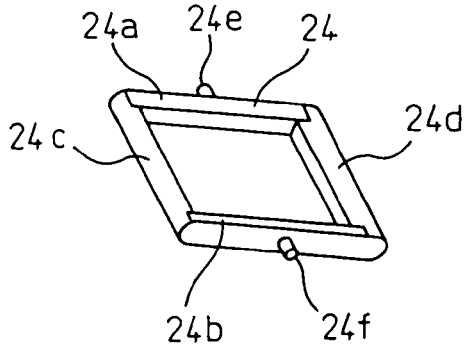
FIG. 5 is a perspective view showing a first link of a link mechanism.
Figure 6:
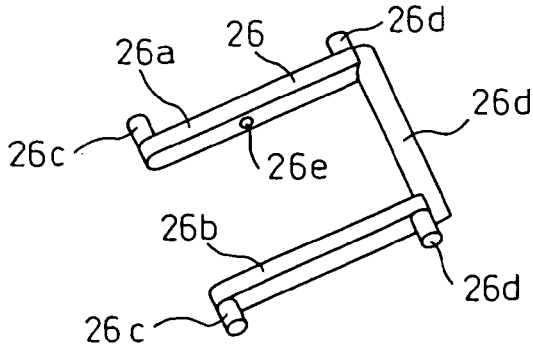
FIG. 6 is a perspective view showing a second link of the link mechanism.

As shown in FIGS. 3, 5 and 6, the link mechanism 20 includes a first link 24 and a second link 26. The first link 24 is a square frame shaped unit having a pair of parallel arms 24*a*, 24*b*, shaft portions 24*c*, 24*d* disposed on ends of the arms 24*a*, 24*b*, and pivot portions 24*e*, 24*f* disposed on outer sides of the centers of the arms 24*a*, 24*b*. The second link 26 is an H-shaped unit larger than the first link 24 and disposed around the first link 24. The second link 26 has a pair of parallel arms 26*a*, 26*b*, shaft portions 26*c*, 26*d* disposed on ends of the arms 26*a*, 26*b*, and holes 26*e* formed in inner sides of the centers of the arms 26*a*, 26*b*. The pivot portions 24*e*, 24*f* of the centers of the first link 24 are inserted into the holes 26*e* of the centers of the second link 26, and the first link 24 and the second link 26 are rotatably connected each other. The first link 24 is positioned within the second link 26 and can be rotated without causing interference therebetween.

As shown in FIGS. 1 to 4, the key-top 18 has a flat top portion 18*a*, and a skirt portion 18*b* obliquely hanging down from the top portion 18*a*. A lower end of the skirt portion 18*b* constitutes a "surrounding portion" of the key-top 18.

Bearings 20*a* and 20*b* are disposed on an inner surface of the top portion 18*a* of the key-top 18 as a pivotal support portion of the link mechanism 20. The shaft portion 24*c* placed on an end of the first link 24 is rotatably supported by the bearing 20*a*. The shaft portions 26*c* disposed on corresponding ends of respective arms 2*a* and 26*b* of the second link 26 are rotatably and movably supported in a horizontal orientation by the bearing 20*a*. On the other hand, as the pivotal support portion of the link mechanism 20, bearings 20*c* and 20*d* are disposed on an upper surface of the housing 16. The shaft portion 26*d* disposed on an end of the second link 26 is rotatably supported by the bearing 20*c*. The shaft portions 24*d* disposed on an end of the first link 24 are rotatably and movably supported in a horizontal orientation by the bearing 20*d*.

As described above, when the key-top 18 is pushed, the height of the link mechanism 20 is reduced so as to guide the key-top 18 downwardly in the horizontal orientation. When the key-top 18 is pushed, the key-top 18 pushes down the switching operation unit 22, and the downward pushing portion 22*a* of the switching operation unit 22 presses and contacts the pair of opposite connecting pieces 14*c* and 14*d*. When the key-top 18 is released, the switching operation unit 22 and the key-top return back to an initial position, by the elastic force of the switching operation unit 22.

Figure 2:
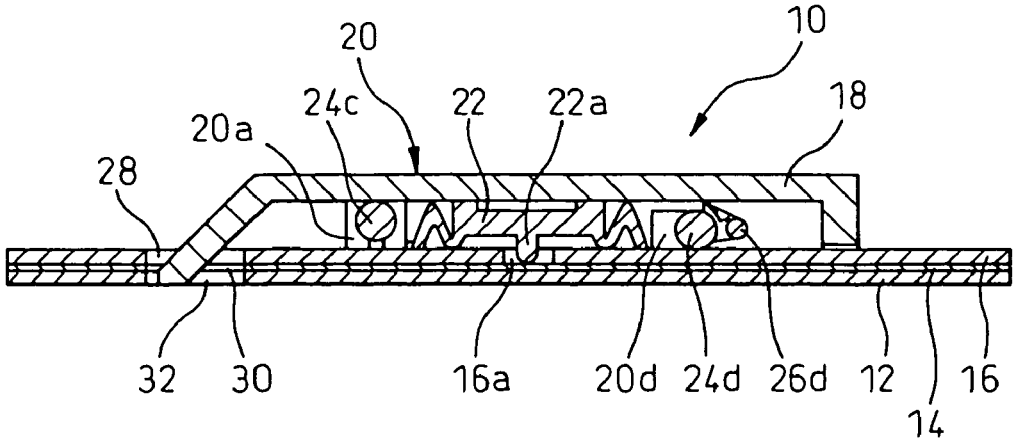
FIG. 2 is a sectional view showing a state of the keyboard of FIG. 1 when a key-top is pushed.

Further, the housing 16 has a slit 28 placed at a surrounding portion of the key-top 18. As shown in FIG. 2, when the key-top 18 is pushed, the surrounding portion of the key-top 18 (lower end of the skirt portion 18*b* of the key-top 18) can be inserted into the slit 28 of the housing 16 without causing interference with the housing 16. Therefore, even if the skirt portion 18*b* of the key-top 18 is long, the distance between the key-top 18 and the housing 16 is shorter, so that a thin keyboard 10 can be realized.

Further, the membrane sheet 14 has a slit 30 at a position corresponding to the slit 28 of the housing 16. Further, the base plate 12 has a slit 32 corresponding to the slit 28 of the housing 16 and the slit 30 of the membrane sheet 14. In the embodiment, the slit 28 of the housing 16, the slit 30 of the membrane sheet 14, and the slit 32 of the base plate 12 are formed as the same position and the same shape each other. Consequently, the key-top 18 can be pushed further down, and the distance between the key-top 18 and the housing 16 can be further shortened, so that a much thinner keyboard can be realized. Preferably, a bottom surface of the surrounding portion of the key-top 18 becomes approximately the same as a bottom surface of the base plate 12 when the key-top 18 is pushed.

As shown in FIG. 3, the slit 28 of the housing 16 is formed as a discontinuous annular shape surrounding the link mechanism 20. The slit 28 is formed as a square frame shaped, and the slit 28 is continuously formed except for one side of the square frame. The slit 28 has first and second end portions 34 and 36.

A bridge shaped portion 38 placed between the first end portion 34 and the second end portion 36 of the slit 28 connects an inner portion 40 of the housing 16 to an outer portion 42 of the housing 16, the inner portion 40 being placed internally of the slit 28, and the outer portion 42 being placed externally of the slit 28. Similarly, the membrane sheet 14 and the slit 30 thereof, and the base plate 12 and the slit 30 thereof are formed as the same as that of the above description.

Consequently, the inner portion 40 of the housing 16 is formed as a land shaped portion placed inside of the slit 28, but the inner portion 40 is connected to the outer portion 42 of the housing 16 placed at the outside of the slit 28 by the bridge shaped portion 38 placed between the first end portion 34 and the second end portion 36 of the slit 28, so that a special connecting unit to connect the inner portion 40 to the outer portion 42 is not necessary. Similarly, in the membrane sheet 14, an inner portion of the slit 30 is connected to an outer portion of the slit 30, so that wiring patterns can be formed on the bridge shaped portion placed between the first end portion 34 and the second end portion 36 of the slit 28.

Figure 4:
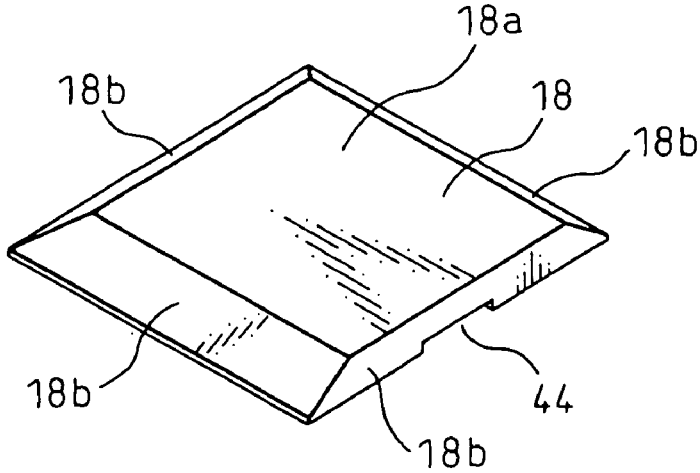
FIG. 4 is a perspective view showing the key-top of FIG. 1.

As shown in FIGS. 1 and 4, the surrounding portion of the key-top 18 has a slit 44 corresponding to the bridge shaped portion 38 placed between the first end portion 34 and the second end portion 36 of the slit 28. Consequently, the surrounding portion of the key-top 18 can be inserted into the slits 28, 39 and 32, and the bridge shaped portion 38 of the housing 16 can be inserted into the slit 44 of the surrounding portion of the key-top 18, so that the key-top 18 can drop down to the lowest position in the horizontal state.

What is claimed is:

1. A keyboard switch, comprising:

a base plate;

a membrane sheet disposed on said base plate and resiliently supporting spaced contact pieces thereon;

a housing disposed on said membrane sheet;

a key-top having an upper portion generally parallel to the base plate and skirt portions depending from the upper portion and toward the base plate, extending substantially about the periphery of the upper portion and having lower edges defining a lower periphery of the key-top;

a link mechanism disposed between said housing and said key-top and resiliently maintaining said key-top in an elevated position relatively to the base plate; and a switching operation unit disposed under said key-top and moved by depressing the key-top toward the base plate, causing the contact pieces carried by the membrane sheet to be moved, against the resilient spacing of the membrane sheet, into contact with each other; and said housing having a slit extending therethrough and receiving lower edges of the skirt portions of said key-top therein, permitting the lower periphery of the key-top to be disposed below upper surface of the housing when the key-top is fully depressed.

2. The keyboard switch, as claimed in claim 1, wherein:

the slit of said housing is formed as a discontinuous annular shape and has first and second ends;

a connecting portion of said housing, extending between said first end and said second ends of said slit, connects a part of said housing inside of said slit to a part of said housing outside of and surrounding said slit; and the surrounding portion of said key-top has a slit at a position corresponding to the connecting portion of said housing extending between said first end and said second ends, the slit of the surrounding portion of said key-top receiving therein the connecting portion of said housing as the key-top is moved to its fully depressed position.

3. The keyboard as claimed in claim 2, wherein a further slit in a skirt portion of said key-top permits the key-top to be depressed toward the base plate, the further slit receiving therethrough the connecting portion of said housing and the lower periphery of the key-top thereby being received in the slit of said housing.

4. The keyboard as claimed in claim 3, wherein:

the key-top is maintained by the link mechanism at a first distance above the base plate; and the key-top is depressible, by collapsing the resilient link mechanism, by a distance greater than the first distance.

5. The keyboard switch as claimed in claim 1, wherein said membrane sheet has a slit corresponding to the slit of said housing.

6. The keyboard switch, as claimed in claim 5, wherein said base plate has a slit corresponding to the slit of said housing and the slit of said membrane sheet.

7. The keyboard switch, as claimed in claim 6, wherein a bottom surface of the surrounding portion of said key-top becomes approximately the same as a bottom surface of said base plate when said key-top fully depressed.

8. The keyboard switch, as claimed in claim 1, wherein the slit of said housing is formed so that the lower periphery of said key-top extends through the slit and does not interfere with said housing when said key-top is pushed downwardly.

9. The keyboard as claimed in claim 1, wherein said link mechanism comprises two groups of links rotatably and pivotally connected to each other, and respective ones of opposite ends of said two groups of links are rotatably supported, repectively by said key-top and said housing.

* * * * *

UNITED STATES PATENT AND TRADEMARK OFFICE

CERTIFICATE OF CORRECTION

PATENT NO. : 7,135,647 B2
APPLICATION NO. : 11/226239
DATED : November 14, 2006
INVENTOR(S) : Koki Takahashi It is certified that error appears in the above-identified patent and that said Letters Patent is hereby corrected as shown below:

Column 4, Line 59, after “below” insert --an--.

Column 6, Line 19, change “repectively” to --respectively--.

Signed and Sealed this

First Day of May, 2007

JON W. DUDAS
*Director of the United States Patent and Trademark Office*